US005419350A

United States Patent [19]

Wegner

[11] Patent Number: 5,419,350

[45] Date of Patent: May 30, 1995

[54] WORKPIECE HOLDING AND ROTATING DEVICE

[75] Inventor: Gary Wegner, Rockford, Ill.

[73] Assignee: PepsiCo, Inc., Purchase, N.Y.

[21] Appl. No.: 90,413

[22] Filed: Jul. 12, 1993

[51] Int. Cl.[6] ..... B08B 9/08

[52] U.S. Cl. ..... 134/79; 134/83; 134/153; 134/142; 294/902

[58] Field of Search ..... 134/153, 157, 142, 158, 134/161, 78, 77, 83, 166 R, 167 R, 168 R, 170; 118/503; 294/902; 901/39

[56] References Cited

U.S. PATENT DOCUMENTS

| | | | |
|---|---|---|---|
| 3,082,776 | 3/1963 | Stauffer | 134/153 X |
| 3,098,764 | 7/1963 | Kao et al. | 118/503 X |
| 4,212,577 | 7/1980 | Swanson | 414/739 X |
| 4,456,022 | 6/1984 | Roberts | 134/142 X |
| 4,650,237 | 3/1987 | Lessway | 294/902 |
| 4,652,195 | 3/1987 | McArthur | 414/739 |
| 4,765,273 | 8/1988 | Anderle | 118/503 |
| 5,215,507 | 6/1993 | Bonig | 901/39 |

FOREIGN PATENT DOCUMENTS

| | | | |
|---|---|---|---|
| 2449767 | 4/1976 | Germany | 134/170 |
| 1135642 | 1/1985 | U.S.S.R. | 294/902 |

*Primary Examiner*—Frankie L. Stinson
*Attorney, Agent, or Firm*—Scully, Scott, Murphy & Presser

[57] ABSTRACT

A workpiece holding apparatus provides concurrent rotational motion to a workpiece as it is held. The apparatus comprises a support bracket for mounting on a fixed or movable support structure. A pair of spaced apart, axially rotatable engaging rollers, each having a circumferential surface profile complementary to a profile of a workpiece, are located on the first support bracket for partially engaging a circumferential surface of the workpiece. A support arm having a third axially rotatable engaging roller with a circumferential surface profile complementary to a profile of a workpiece for partially engaging the circumferential surface of the workpiece is pivotably mounted on the support structure. The support arm is biased toward the support bracket to enable engagement of each axially rotatable engaging roller with an appropriately positioned workpiece, or is pivoted away from the support bracket to release the workpiece from the engaging rollers. Each axially rotatable engaging roller is connected to each other by a flexible drive belt. A drive motor applies rotational motion to one of the axially rotatable engaging rollers enabling all three rotatable engaging cylinders and the workpiece being held thereby to rotate.

27 Claims, 5 Drawing Sheets

WORKPIECE HOLDING AND ROTATING DEVICE

BACKGROUND OF THE INVENTION

1. Field of the Invention

The present invention generally relates to the art of rotating and holding workpieces, such as plastic bottles and the like, for conveyance or transfer through a treatment zone or from one location to another. More particularly, this invention is drawn to a novel holding device that concurrently rotates the work piece while it is transported from one location to another, and further, is adaptable for use in a variety of work environments requiring workpiece rotation, e.g., automated bottle spraying, washing, sanitizing and bottle labelling systems and the like.

2. Discussion of Prior Art

The manufacture of returnable and refillable bottles has become widespread in both the glass and plastic bottling industries. Many countries have mandated their use in an effort to conserve energy and to keep raw material consumption to a minimum. Furthermore, commercially viable, refillable bottles and containers not only conserve energy, but help to reduce land-fill and recycling problems usually associated with disposable type plastic and glass bottles and containers. One industry in particular where the desirability of utilizing reusable and refillable plastic bottles is increasing, is in the soft drink beverage bottling industry.

To be commercially viable as a refillable bottle for soft drink beverages, the plastic bottle must retain its aesthetic and functional qualities over a minimum of ten and preferably over twenty cycles or "trips" in its lifetime. A typical cycle that a returnable/refillable plastic bottle goes through has been described in numerous patents and technical articles. For instance, U.S. Pat. No. 4,725,464 to Collette, incorporated by reference herein, describes a cycle as comprising: 1) an empty caustic wash followed by 2) contaminant inspection and product filling/capping, 3) warehouse storage, 4) distribution to wholesale and retail locations, and 5) purchase, use, and empty storage by the consumer followed by eventual return to the bottler. Presently, plastic beverage bottles made of polyesters, such as polyethylene terephthalate (PET) and copolymers thereof, acrylonitrile, and polycarbonate have the requisite physical and aesthetic qualities most desirable for producing refillable plastic containers. As is well known in the art, PET offers the best balance of properties and, cost and performance ratios.

While the plastic bottling industry has made great strides in obviating the problems associated with the production of commercially viable returnable and refillable plastic bottles in terms of maintaining the chemical and structural integrity of the plastic bottle after repeated caustic washing, problems still arise during the caustic wash process of the typical cycle described above. For instance, many bottles or containers are subject to excessive scuffing because of the way they are handled in the washing machines of the prior art. In addition, the temperature of washing fluids and rough handling may also be a source of bottle stress induced cracking.

Prior art automatic and semi-automatic bottle washing apparatuses, such as the straight line systems described in U.S. Pat. Nos. 4,080,974 and 4,125,120 and the automated rotary systems described in U.S. Pat. Nos. 3,226,757, 3,534,749, and 5,135,014 each provide for the exterior and/or interior washing of the bottle while it is fixed in one position or while the bottle is moving from one treatment zone to another. A problem associated with these current automated spray washing apparatuses is that many bottles are subject to stress crack failure by reason of the combination of the high temperature wash solution, the caustic nature of the solution and the way they are handled. For instance, the automated in-line and rotary bottle washing systems mentioned above currently provide mechanisms for holding or suspending containers, for example, by cradle (U.S. Pat. No. 4,080,974), basket (U.S. Pat. No. 4,154,624), carriage (U.S. Pat. No. 4,461,054), or by fixed mounting means (U.S. Pat. No. 3,534,749), as the bottles are being conveyed or transferred through the wash treatment. Both scuffing and stress crack failure occur in these mechanisms as the bottles rub or brush against each other or against a holder or other surface while in transit.

In view of the above-mentioned limitations and disadvantages of the bottle handling devices found in current automated bottle washers, there is accordingly a need to provide an apparatus for holding and rotating bottles or containers in a manner that minimizes the stress in the neck and shoulder regions and that does not require any sort of retaining or locking means.

SUMMARY OF THE INVENTION

An object of this invention is to provide a bottle holding and rotating device that engages an invertedly positioned bottle in a manner so as to provide support at three points of contact, while simultaneously providing bottle rotation.

Another object of this invention is to provide a bottle handling apparatus that can provide axial rotational motion to the bottle such that, when its interior is subject to a cleaning fluid spray from a specially configured spray nozzle, a more precise and effective chemical and mechanical cleaning of the interior of the bottle is accomplished.

Still another object of the present invention is to provide a bottle holding device that may be used in a high-speed automated straight line and rotary spray-washing systems, and that requires a minimum of mechanical parts resulting in a decreased likelihood of mechanical breakdowns.

These and other objects of the present invention are attained with a workpiece holding and rotating device that comprises a first support means mounted on a support structure having mounted thereupon first and second rotatable grip means in a spaced apart relation correlating to the size of the workpiece, each of the first and second rotatable grip means configured at a first end for complementing a circumferential surface of the workpiece. A second support means is pivotally mounted to the support structure and extends outward therefrom. This second support means includes a third rotatable grip means, wherein the third rotatable grip means is configured at a first end for complementing another circumferential surface of said workpiece. Drive belts are configured about each of the first, second and third rotatable grip means so that when driven by a drive means, simultaneous rotation of said first, second and third rotatable grip means is accomplished. To engage the workpiece, the second support means is biased toward the first and second rotatable grip means to mate with a workpiece placed therebetween. The drive means will provide simultaneous axial rotation of the first, second and third rotatable grip means and the workpiece that is gripped thereby. To release the workpiece, a cam means is provided to pivot the second support means and the third rotatable grip means away from the first support means, so that the bottle may be easily removed.

The workpiece holding and rotating device of the instant invention is especially adapted to engage the circumferential neck ring surface of a plastic bottle. By providing only three points of engagable contact with the bottle, forces applied to the bottle are minimized and the likelihood of induced stress crack failure or excessive scuffing is reduced. To further minimize the opportunity of scuffing and stress crack failure, a shock absorbing mechanism is provided to allow slight translational motion of one of the first and second rotatable grip means. This shock absorbing mechanism comprises a follower means connected to a compressible spring means. Thus, when the second support means is biased toward the first support means to enable engagement of each rotatable grip means with the neck ring portion of the bottle, one rotatable grip means and the follower means will receive the thrust of any impact and the spring will be compressed accordingly. Naturally, the spring will restore the rotatable grip means and the follower means back to its normal and engaging position.

A plurality of bottle holding and rotating devices may be found along the periphery of a high-speed automatic rotary washer spraying system that may provide thorough chemical and mechanical cleaning of a bottle in as fast as 16 seconds. Moreover, a thorough cleaning of the interior surface of a bottle is accomplished by the combination of rotating the bottle and strategically subjecting the interior surface of the bottle with highly directional jets of pressurized fluid detergents. This combination obviates the need to soak the bottles in a hot caustic bath which is a time consuming and costly process.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENTS

Figure 1:
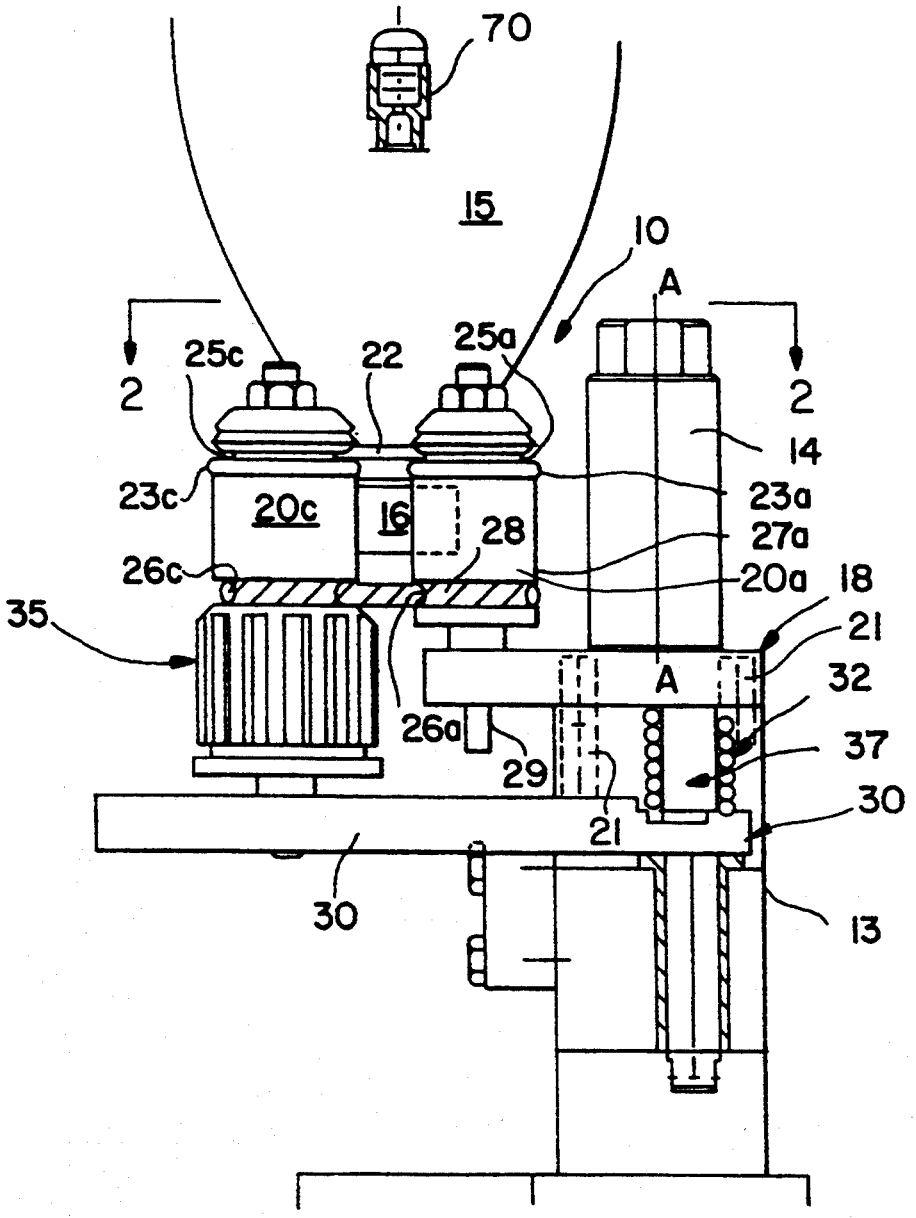
FIG. 1 is a detailed side view of the workpiece holding apparatus shown gripping a bottle in an inverted position.
Figure 2:
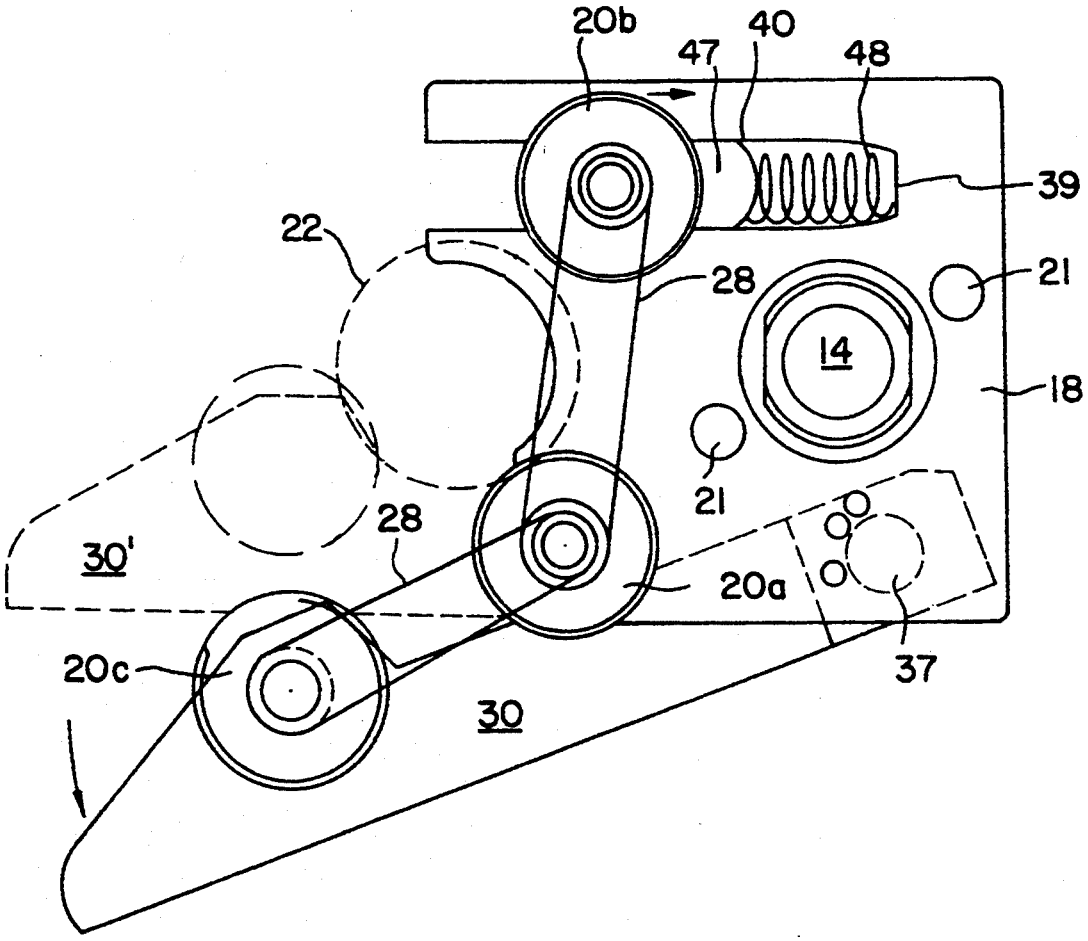
FIG. 2 is an overhead view taken along line 2—2 of FIG. 1 of the workpiece holding apparatus of the instant invention.

Referring to FIGS. 1 and 2 there is shown a workpiece holding apparatus 10 that in the preferred embodiment may be fixedly or pivotly mounted to support column 14 which is disposed on top of support structure 13 which is itself part of a moving assembly that transports the workpiece for various types of processing. In the preferred embodiment, the workpiece is a plastic bottle or container 15 shown in FIG. 1 in an inverted position with the open ended neck 16 facing downward. As will be explained below, the workpiece holder 10 may be configured to accommodate plastic or glass bottles or containers in a wide variety of sizes and configurations.

The workpiece holding apparatus 10 includes a fixed support bracket 18 and a pivotable support arm 30 both extending traversely from the support structure 13. Support bracket 18 is attached to support structure 13 by any suitable attachment device such as bolts 21 shown as phantom lines in FIG. 1. Rotatably mounted to support bracket 18 are a pair of rotatable engaging rollers **20*a* and 20*b*, one of which is shown in FIG. 1. In the preferred embodiment, each rotatable engaging roller 20*a* and 20*b* is a cylinder and is circumferentially configured at a first end 23*a* with an indent or groove 25*a* that is complementary to a surface of the bottle and particularly, its neck ring 22. For other applications, the surface of each rotatable engaging roller may be configured differently to enable engagement with a bottle or workpiece having a different surface configuration. Rotatable engaging rollers 20*a* and 20*b* may also be spaced at different distances to accommodate workpieces or bottles 15** of various widths and sizes.

Configured at the other end **27*a* of each rotatable engaging roller 20*a,b* is a groove 26*a* for engaging a drive belt 28. Drive belt 28 is a flexible rubber belt in the preferred embodiment and is conformed around each roller 20*a,b* to impart rotational motion to the same when driven by a drive means 45 shown in FIG. 3** and explained in detail below.

Workpiece holding apparatus 10 includes a pivotable support arm 30 having a rotatable engaging roller **20*c* mounted thereon. Support arm 30 is located below support bracket 18 in the preferred embodiment and as illustrated in FIG. 1, is separated therefrom by a biasing mechanism such as spring 32 shown in FIG. 1. Biasing mechanism 32 normally biases support arm 30 into an engaged position with the workpiece or bottle 15. Workpiece or bottle 15 is thus engaged at three points by rollers 20*a,b* and rotatable engaging roller 20*c* mounted on support arm 30. The bottle engaging position is indicated by the broken lines of support arm 30' shown in FIG. 2. When the workpiece holding apparatus 10 is opened by cam means 65 shown generally in FIG. 3, support arm 30 will be pivoted about shaft 37 in the direction indicated by the arrow in FIG. 2. When pivoted in this position, the support bracket 18 and support arm 30 are angled apart to either permit positioning of the neck ring 22 of any bottle 15 between the grooves 25*a,b,c* of each rotatable engaging roller 20*a,b,c* prior to engagement thereof, or to permit the release of the bottle 15 from the workpiece holder 10**.

Rotatably mounted on support arm 30 is rotatable engagement roller **20*c* which is also configured at an end 23*c* with an indent or groove 25*c* that is complimentary to and for engaging neck ring 22 of bottle 15. In the preferred embodiment, the grooves 25***a,b,c* of rotatable engagable rollers 20*a,b,c* are horizontally coplanar to mate with neck ring 22 and to hold bottle 15 in an upright position (FIG. 1). The rollers having indents or grooves 25*a,b,c* may also be disposed in an angled plane relative to fixed support bracket 18. This configuration would permit holding and rotating of the bottle 15 in an inclined position.

Configured at an edge of rotatable engaging roller 20*c* is groove 26*c* for engaging drive belt 28. In the preferred embodiment, rotatable roller 20*c* is also provided with a sprocket 35 which is connected to an external drive motor 45 via a timing belt or chain 46 as shown in FIG. 3.

Figure 3:
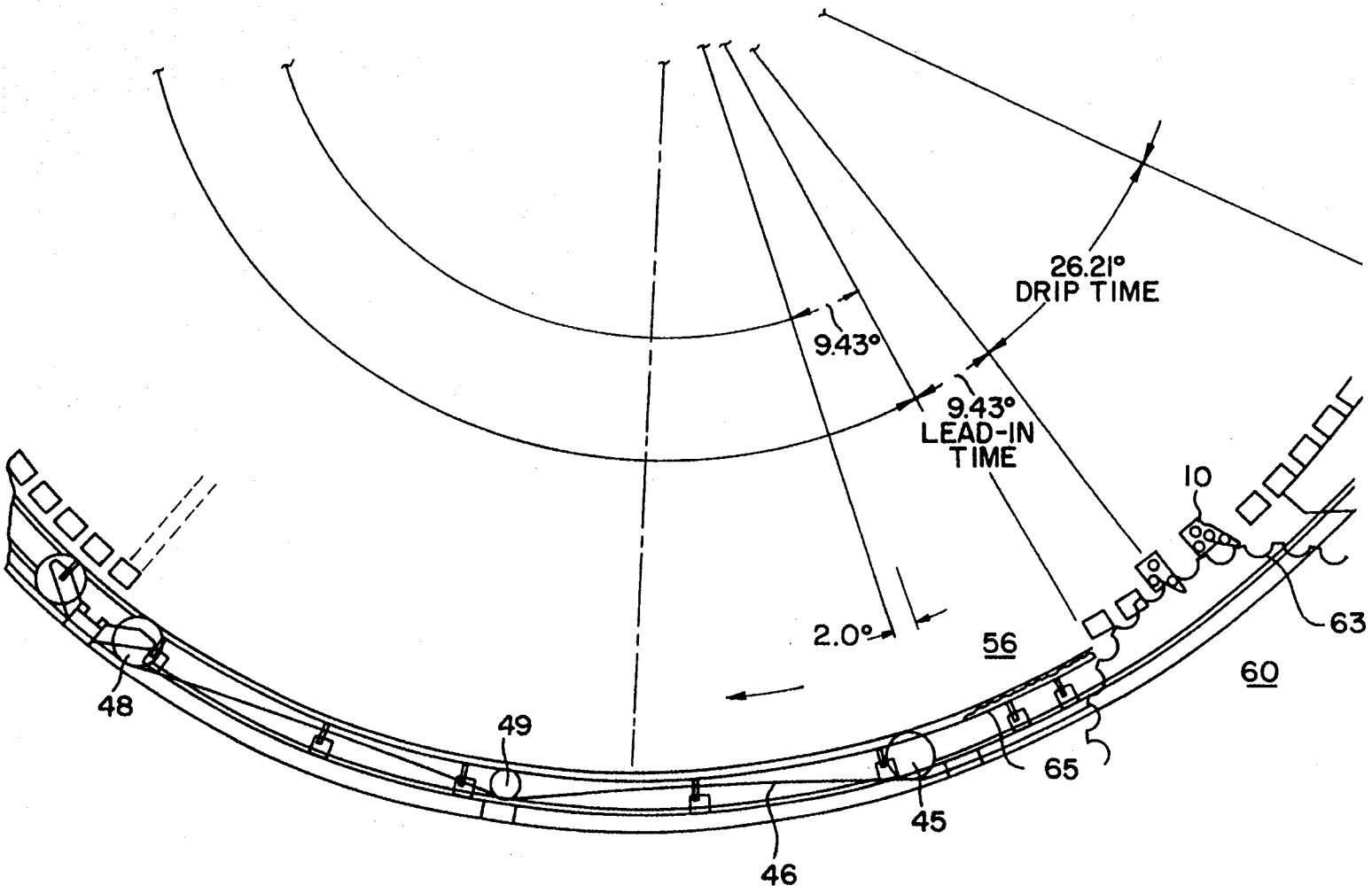
FIG. 3 is an overhead view of a portion of one carousel of an automated rotary washer spraying system having a motor drive means for imparting rotation to a bottle held by the apparatus of the present invention.

FIG. 3 illustrates in detail the drive means 45 which is a motor for providing rotation to rotatable engaging roller 20*c*. The drive means 45 imparts rotational motion to timing belt 46 shown configured around sprocket 48 and idler 49. As illustrated, the drive means 45 is located about the peripheral portion of wash carousel 56. In operation, a bottle is transferred from infeed starwheel 60 to the openly biased bottle holding and rotating device 10. A cam means 65 pivots the bottle holding and rotating device 10 to enable engagement of the bottle in the manner described above. As the bottle holding and rotating device travels in the direction shown by the arrow in FIG. 3, the timing belt 46 engages the sprocket 35 of each rotatable engaging roller 20*c*. The drive motor 45 is actuated to provide rotation of the timing belt 46 and consequently rotatable engaging roller 20*c*. Rotational motion of engaging roller 20*c* is simultaneously imparted to rotatable engaging rollers 20*a* and 20*b* due to flexible drive belt 28. When neck ring 22 of bottle 15 is engaged by grooves 25*a, b* and *c* the kinetic friction caused by rotational motion of the rotatable engaging rollers 20*a,b,c* will cause axial spinning of the bottle 15 in the opposite direction. In the preferred embodiment, the external drive motor 45 will cause rotation of the bottle at a rate anywhere from 2 to 20 r.p.m., with 12 r.p.m. preferred. Additionally, in the preferred embodiment, an idler sprocket 49 is included midway between drive motor 45 and sprocket 48 to ensure that the portion of the timing belt 46 not engaged with sprocket 35 of rotatable engaging roller 20*c* does not interfere with the movement of the timing belt 46. It should be understood that several drive means 45 are located about the periphery of carousel 50 so that bottle rotation may occur at a predetermined number of locations along its traversal about the carousel 56 for as long a duration as required.

As shown in FIG. 2, support bracket 18 is provided with an impact absorbing mechanism 40 that comprises a follower means 47 located adjacent to rotatable engaging roller 20*b* and a spring 38 fixed at one end 39 to support bracket 18. This absorbing mechanism will allow slight horizontal translation motion of rotatable engaging roller 20*b* and follower means 47 when the support arm 30 is biased toward support bracket 18 to enable engagement of the bottle neck ring 22 within grooves 25*a,b,c*. The spring 38 will be compressed and will provide a natural restoring force to return the follower means 47 and rotatable engaging roller 20*b* to its natural position shown in FIG. 2. Allowing translational movement of rotatable engaging roller 20*b* in the direction of the arrow shown in FIG. 2 will minimize the forces applied to the neck 16 and neck ring 22 of the bottle 15 either when the bottle or workpiece has a surface irregularity or protrusion, or when the rotatable rollers 20*a,b,c* engage the bottle 15 after pivoting of support arm 30 back to its normal position. In essence, impact absorbing mechanism will help decrease the likelihood of stress crack failure in the bottle.

In the preferred embodiment, the workpiece and bottle holding and rotating apparatus 10 is configured to hold and rotate a returnable and refillable polyethylene terephthalate plastic bottle of any size and volume. Preferably, a plurality of bottle holding and rotating apparatuses are disposed about the circumferential portion of each carousel 56 and 57 of the rotary washer spraying system 50 shown generally in FIG. 4, although they may be disposed in an in-line washer spraying system, or, in an automatic adhesive labelling system and the like.

Figure 4:
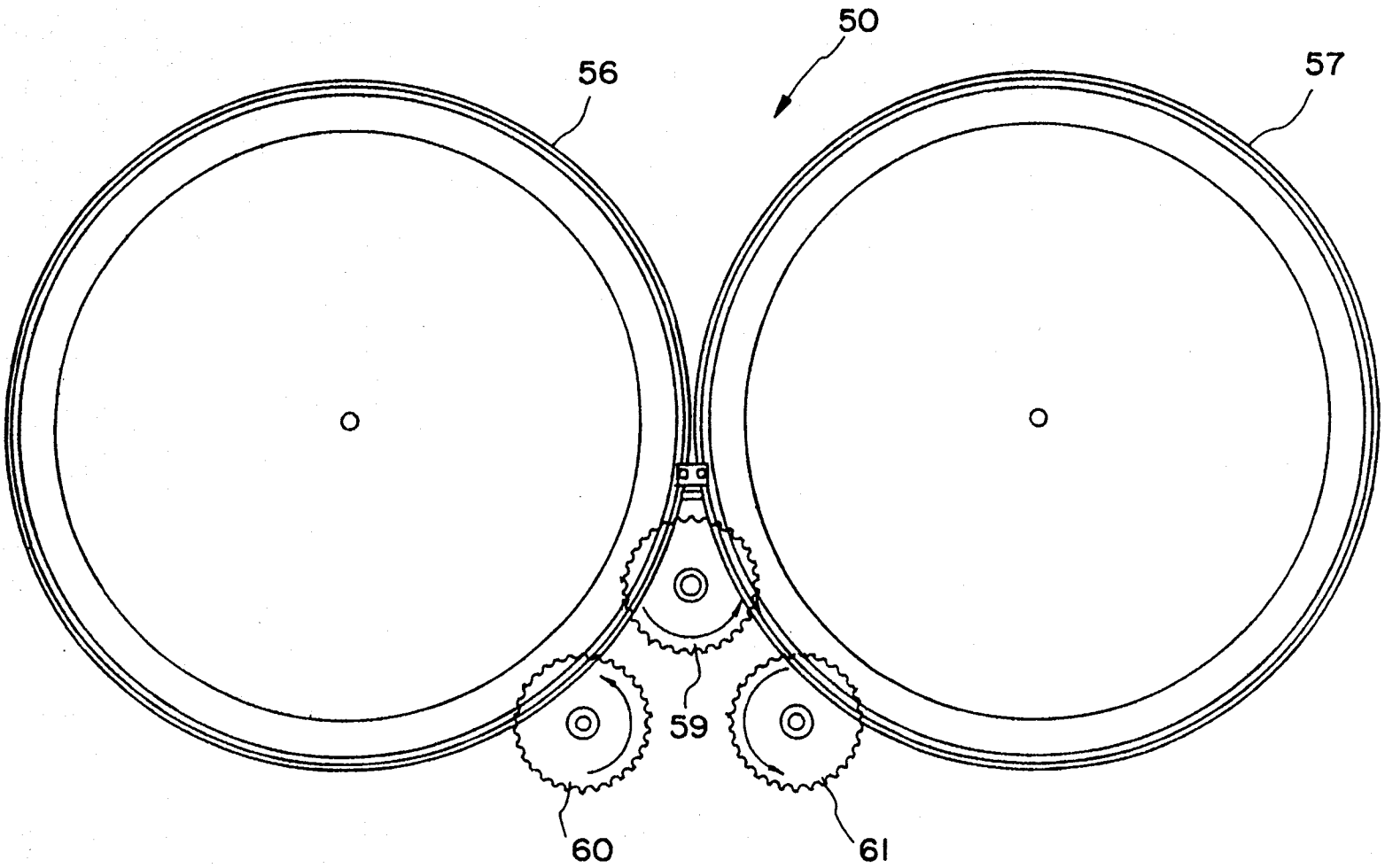
FIG. 4 is a general view of an automated high-speed rotary washer spraying system incorporating the apparatus of the present invention.

FIG. 4 illustrates generally the operation of carousels 56, 57 and starwheels 59, 60 and 61 of rotary washer spraying system 50. As illustrated, infeed rotational starwheel 60 feeds the bottle holding and rotating devices of carousel 56 rotating in the direction shown with bottles in a neck-down attitude. Transfer starwheel 59 transfers a bottle from carousel 56 to bottle holding and rotating devices of carousel 57 for further processing. Outfeed starwheel 61 transfers the bottles from carousel 57 to an outfeed conveyor (not shown).

Figure 5:
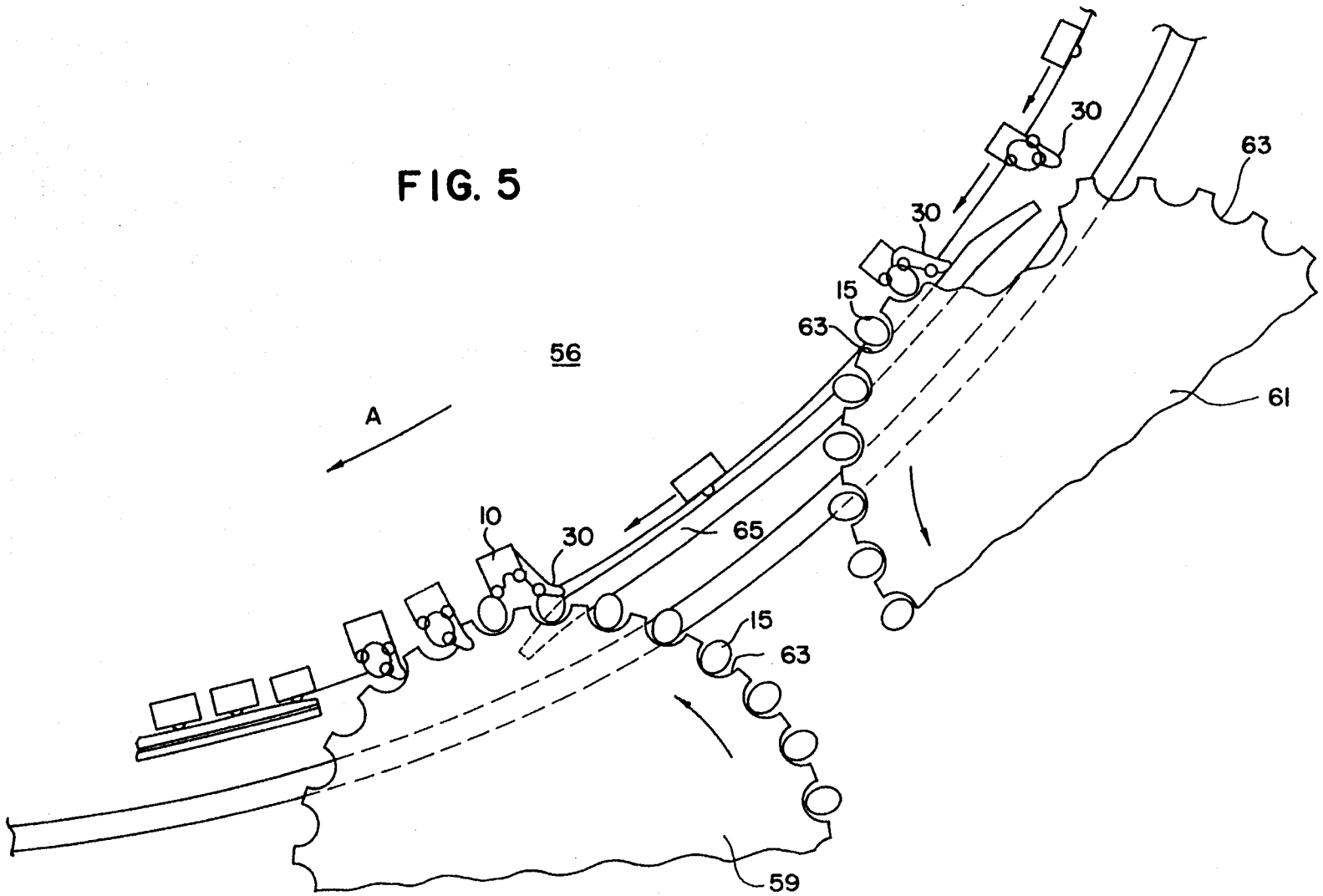
FIG. 5 is a detailed view of a section of the rotary washer spraying system illustrating the transfer of bottles to and from respective workpiece holding apparatuses of the present invention.

FIG. 5 illustrates in greater detail starwheels 59 and 61 which are provided with a suction grip in each pocket 63. In operation, a plurality of inverted bottles 15 are gripped by grip pockets 63 of starwheel 59 that are rotating in the direction shown by the arrows in FIG. 5, and are each successively transferred to a respective bottle holder 10 located at the periphery of carousel 56. In the preferred embodiment, the rotary washer spraying system 50 can accomplish approximately 480 transfers per minute. To accomplish a transfer, support arm 30 is biased by external cam 65 at the appropriate moment to enable engagement with an appropriately registered bottle 15 as described above. Once the bottle 15 is rotatably engaged by the bottle holder 10 in the manner described above, the bottle may be subject to various types of processing for e.g., internal and external washing, drying, removing or applying adhesives and/or labels, or the like. While being transferred to a location where cleansing or washing of the interior of the bottle takes place, the bottle 15 is caused to rotate by the drive means 45 and timing belt 46 shown in FIG. 3. A spray nozzle 70 may be injected into the open end 16 of inverted bottle 15 as shown in FIG. 1 and suitable cleansing fluid may be sprayed into the interior of the bottle while it is axially rotating. The simultaneous process of rotating the bottle 15 while spraying its interior from spray nozzle 70 will result in a more effective mechanical and chemical cleansing of the interior of bottle 15.

After a complete traversal about carousel 56, the support arm 30 is biased by externally located cam means 65 at the appropriate moment to disengage and release bottle 15 into the grip pocket 63 of rotating starwheel feed 61 to convey the bottle 15 for inspection or further processing.

While the invention has been particularly shown and described with respect to preferred embodiments thereof, it will be understood by those skilled in the art that the foregoing and other changes in form and details may be made therein without departing from the spirit and scope of the invention, which should be limited only by the scope of the appended claims.

What is claimed is:

1. An apparatus for holding and rotating a workpiece comprising:

(a) first and second rotatable engaging means rotatably mounted on a first support means in a spaced relationship, each of said first and second rotatable engaging means having a circumferential surface profile complimentary to a profile of a workpiece to be rotated;

(b) a third rotatable engaging means rotatably mounted on a second support means, said third engaging means having a circumferential surface complimentary to said circumferential surface of said workpiece to enable gripping of the same; and (c) means for biasing said second support means toward said first support means to enable said first, second, and third rotatable engaging means to grip said workpiece positioned therebetween, said first support means including a means for absorbing impact upon one of said first and second rotatable engaging means when said second support means is biased toward said first support means; and (d) a drive means for simultaneously rotating said first, second, and third rotatable engaging means and imparting simultaneous axial rotation to said workpiece gripped thereby.

2. An apparatus according to claim 1 wherein each of said first, second and third rotatable engaging means is a cylindrical roller.

3. An apparatus according to claim 2 wherein said workpiece has a circumferential protrusion, wherein each of said first, second and third rotatable engaging means have indented profiles which are complementary to said protrusion.

4. An apparatus according to claim 3 further including means for pivoting said second support means away from said first support means to release said workpiece from said first, second, and third rotatable engaging means.

5. An apparatus according to claim 4 wherein said pivoting means pivots said second support means away from said first support means to enable positioning of said workpiece in said apparatus.

6. An apparatus according to claim 5 wherein each of said first, second and third rotatable engagement means are disposed substantially horizontally coplanar.

7. An apparatus according to claim 4 wherein said means for pivoting said second support means is a cam.

8. An apparatus according to claim 1 wherein said absorbing means includes a spring means that is compressed to absorb horizontal motion of one of said rotatable engaging means upon engagement with said workpiece.

9. An apparatus according to claim 8 wherein said absorbing further includes a follower means having a first side located adjacent to one of said first and second rotatable engaging means and a second side connected to said spring means, said follower means transferring said horizontal motion of one said first and second rotatable engaging means to said spring means for compression thereof.

10. An apparatus according to claim 9 wherein a circumferential portion of each of said first, second, and third rotatable engaging means is configured to receive said drive belt.

11. An apparatus according to 10 wherein said drive motor means includes an idler means for preventing a first portion of said timing belt from interfering with a second portion of said timing belt while imparting rotational motion to at least one of said first, second, and third rotatable engaging means.

12. An apparatus according to claim 1 wherein said drive means includes a drive belt which engages said first, second and third rotatable engaging means, and a drive motor for rotating one of said first, second or third rotatable engaging means at a predetermined rate.

13. An apparatus according to claim 12 wherein said drive motor means includes a timing belt for imparting rotational motion to at least one of said first, second, and third rotatable engaging means.

14. An apparatus according to claim 12 wherein said predetermined rate ranges from 2 to 20 r.p.m.

15. An apparatus according to claim 1 wherein said first support means and said second support means are mounted on a moving assembly.

16. An apparatus according to claim 15 wherein said moving assembly is an automated rotary washer spraying system.

17. An apparatus for holding a bottle comprising:

(a) first and second rotatable engaging means each rotatably mounted on a first support means and each having an annular groove for engaging a circumferential neck ring surface of said bottle to be rotated;

(b) third rotatable engaging means rotatably mounted on a second support means and having an annular groove for engaging said circumferential neck ring surface of said bottle to be rotated;

(c) means for biasing said second support means toward said first support means to enable said annular grooves of first, second, and third rotatable engaging means to engage said neck ring portion of said bottle positioned therebetween, said first support means including a means for absorbing impact upon one of said first and second rotatable engaging means when said second support means is biased toward said first support means; and (d) driving means for simultaneously rotating said first, second, and third rotatable engaging means to enable simultaneous axial rotation of said bottle engaged thereby.

18. An apparatus according to claim 17 wherein each of said first, second and third rotatable engaging means is a cylindrical roller.

19. An apparatus according to claim 18 further including means for pivoting said second support means away from said first support means to release said bottle from said first, second and third rotatable engaging means.

20. An apparatus according to claim 19 wherein said pivoting means further pivots said second support means away from said first support means to enable positioning of said bottle in said apparatus.

21. An apparatus according to claim 20 wherein each of said first, second and third rotatable engagement means are disposed substantially horizontally coplanar.

22. An apparatus according to claim 17 wherein said absorbing means includes a spring means that is compressed to absorb horizontal motion of said bottle upon engagement with said first, second, and third rotatable engagement means.

23. An apparatus according to claim 17 wherein said drive means includes drive belt which engages said first, second and third rotatable engaging means, and a drive motor means for rotating one of said first, second or third rotatable engaging means at a predetermined rate.

24. An apparatus according to claim 23 wherein said drive motor means includes a timing belt for imparting rotational motion to at least one of said first, second, and third rotatable engaging means.

25. An apparatus according to claim 23 wherein said predetermined rate ranges from 2 to 20 r.p.m.

26. An apparatus according to claim 17 wherein said first support means and said second support means are mounted on a moving assembly.

27. An apparatus according to claim 26 wherein said moving assembly is an automated rotary washer spraying system.

* * * * *

UNITED STATES PATENT AND TRADEMARK OFFICE

CERTIFICATE OF CORRECTION

PATENT NO. : 5,419,350

DATED : May 30, 1995

INVENTOR(S) : Gary Wegner

It is certified that error appears in the above-indentified patent and that said Letters Patent is hereby corrected as shown below:

Column 7, line 65, Claim 11: "to 10" should read --to claim 10--

Signed and Sealed this

Second Day of April, 1996

Bruce Lehman

*Attest:*

BRUCE LEHMAN

*Attesting Officer*

*Commissioner of Patents and Trademarks*